US006110345A

United States Patent [19]

Iacoponi

[11] Patent Number: 6,110,345

[45] Date of Patent: Aug. 29, 2000

[54] METHOD AND SYSTEM FOR PLATING WORKPIECES

[75] Inventor: John Iacoponi, San Jose, Calif.

[73] Assignee: Advanced Micro Devices, Inc., Sunnyvale, Calif.

[21] Appl. No.: 09/198,610

[22] Filed: Nov. 24, 1998

[51] Int. Cl.[7] ..... C25D 21/12

[52] U.S. Cl. ..... 205/82; 205/84; 205/137; 205/157; 204/198; 204/228.1

[58] Field of Search ..... 205/82, 84, 137, 205/157; 204/228.1, 198

[56] References Cited

U.S. PATENT DOCUMENTS

| | | | |
|---|---|---|---|
| 4,514,266 | 4/1985 | Cole et al. | 204/28 |
| 4,576,685 | 3/1986 | Goffredo et al. | 204/30 |
| 4,755,476 | 7/1988 | Mallory et al. | 324/158 |
| 5,244,875 | 9/1993 | Hauser et al. | 505/1 |

FOREIGN PATENT DOCUMENTS

| | | |
|---|---|---|
| 554321 | 7/1977 | U.S.S.R. . |

*Primary Examiner*—Kathryn Gorgos
*Assistant Examiner*—Christopher Keehan

[57] ABSTRACT

A method and a system are provided for plating workpieces as part of an "on-track" in-line or a radially arranged manufacturing system, including "on-site" measurement of at least one plating characteristic for computer controlled process regulation and quality control. Movement of workpieces between various stations is controlled in response to a comparison of the measured value(s) of the plating characteristic(s) and (a) target value(s) or target range(s) of values.

21 Claims, 1 Drawing Sheet

METHOD AND SYSTEM FOR PLATING WORKPIECES

FIELD OF THE INVENTION

The present invention relates to a method and system for plating workpieces, including "on-site" measurement of a selected plating property for regulation and quality control of a product manufacturing line. More particularly, the invention relates to an improved method and system for "back-end" metallization of integrated circuit semiconductor devices which provide enhanced quality control, increased manufacturing throughput, with full compatibility with existing semiconductor manufacturing process technology and methodology.

BACKGROUND OF THE INVENTION

Metal films are conventionally utilized in semiconductor manufacturing technology to form electrically conductive contacts to active as well as passive device regions or components formed in or on a semiconductor wafer substrate, as well as for filling via holes, interlevel metallization, and interconnection routing patterns for wiring together the components and/or regions. Because many large scale integration (LSI), very large scale integration (VLSI), and ultra large scale integration (ULSI) devices presently manufactured are very complex and require multiple levels of metallization for interconnections, it has been common to repeat metallization processing multiple times, e.g., to form five or more levels of metallization interconnected by conductive vias. Thus, in the course of manufacturing such devices, each wafer requires passage through one or more metallization systems arranged along a device production line or path.

Metals commonly employed for "back-end" metallization purposes include nickel, titanium, tantalum, aluminum, chromium, gold, silver, copper, and alloys thereof, which metals may be applied to the semiconductor wafers by a variety of techniques, including, but not limited to, electroplating, electroless plating, dipping, pasting, spraying, physical vapor deposition (e.g., evaporation, sputtering, ion plating, plasma spraying, etc.), and chemical vapor deposition (including plasma enhanced chemical vapor deposition). Of the enumerated metals and deposition methods, metallization by electroplated copper or copper-based alloys is particularly attractive for use in LSI, VLSI, and ULSI multilevel metallization systems used for "back-end" processing of semiconductor wafers. Copper and copper-based alloys have very low resistivities, i.e., even lower than that of previously preferred aluminum and aluminum alloys, as well as significantly higher resistance to electromigration. Moreover, copper and its alloys enjoy a considerable cost advantage over a number of the above metals, in particular silver and gold. Lastly, copper and its alloys can be readily deposited in layer form by well-known electroplating techniques, at deposition rates compatible with the requirements of adequate manufacturing throughput.

A significant drawback associated with electroplating systems employed as part of in-line semiconductor manufacturing systems is the inability to measure the plated film properties concurrently with electrodeposition, or at the least, very shortly after withdrawal of the plated semiconductor wafer workpieces from the electroplating bath. Referring to FIG. 1, illustratively shown therein in schematic form, is a diagrammatic top view of a conventional automated or semi-automated "on-track" system 1 which forms a portion of a device manufacturing line, e.g., a manufacturing line for processing semiconductor wafer substrates into a plurality of integrated circuit device regions, which regions are ultimately formed into chips by dicing. On-track automated semiconductor manufacturing systems of the type contemplated for use as herein described may, for example, be obtained from Semitool, Inc. (Kalispell, MT) under the designation LT 210 and suitably adapted for performing electroplating processing as necessary for a particular manufacturing process sequence. The inventive concept is also well adapted for use with alternative arrangements or configurations of process stations and wafer transport mechanisms, such as radially configured apparatus (available from Applied Materials, Santa Clara, Calif.; Novellus, San Jose, Calif.; Semitool, Inc., Kalispell, Mont.; and TEL, Tokyo, Japan) wherein process chambers or stations are arranged in a radial fashion around a central pivoting robot. Moreover, since modern robots and control systems are capable of moving workpieces to or from a number of different locations, the arrangement of process chambers or stations in a radial or linear apparatus need not necessarily be from left to right, but could be from left to right, and then back from right to left, for a number of oscillation cycles.

As illustrated, electroplating system 1 comprises an enclosure 2, a workpiece transport mechanism 3, termed a "track" for transporting workpieces such as semiconductor wafers (not shown) contained in cassette-type workpiece holders 4, 4', each capable of supplying, storing, and receiving a plurality of wafers as they pass through various processing stations along the manufacturing line. In the figure, and simply for the purpose of disclosing the principle of the present invention, workpiece holder 4 on track 3 is shown as transporting into enclosure 2 semiconductor wafer workpieces from an upstream portion of the manufacturing line comprising stations (not shown) for performing antecedent processing, and workpiece holder 4' is illustrated as within the processing enclosure having received plated, post-treated wafer workpieces for storing therein, and as having exited the enclosure via track 3 for supplying the plated, post-treated wafer workpieces to a subsequent processing station (not shown).

Electroplating system 1 comprises from left to right within the enclosure 2 and in the direction of workpiece transport, a first, electroplating station 5 and a second, post-treating station 6 where the just-plated workpieces are rinsed and dried prior to exiting the enclosure. It is to be understood that both cassette-type workpiece holders 4, 4' as shown in the drawing for illustrative purposes only, are identically capable of supplying, storing, and receiving wafer workpieces, as necessary, for performing sequential processing thereof as described.

Located exteriorly of the enclosure 2 (i.e., "stand-alone" placement) is a third, measuring station 7 for determining at least one film characteristic of a representative sample 8 of the just-plated workpieces, e.g., electrical resistivity, thickness, and reflectivity, for determining whether proper electroplating and rinsing/drying conditions have been established in first and second stations 5, 6, respectively, and for adequate quality assurance. Specifically, measurement of film resistivity, as by use of a 4-point probe or a contactless device comprising third station 7, is essential for determining whether electrical connections of sufficiently low resistivity have been established as a result of the electroplating; adequate film thickness is necessary for ensuring complete surface coverage as well as sufficient electrical conductivity. Reflectivity is indicative of the overall quality and effectiveness of the electroplating, e.g., bright copper plating.

A number of drawbacks are associated with such conventional manufacturing technology as a consequence of the "stand alone" placement of the third, measuring station 7. For example, if the workpiece transfer mechanism, i.e., track 3, is shut down for removal of the test wafer 8, periodic withdrawal and testing of a plated wafer workpiece 8 necessarily entails lost productivity. Should the production line continue to run during testing (for making the same or a different product), and the testing indicates one or more substantial deviations from standard, desired film characteristics, there is a significant risk of producing "out-of-spec" product. A further drawback of the "stand alone" testing arrangement is the inability to rapidly adjust plating conditions in response to film measurement. Nor is it possible to conveniently re-cycle out-of-spec wafers for an additional pass through the electroplating system 1 to increase under-spec film thicknesses and/or decrease over-spec resistivities to acceptable levels.

Thus, there exists a need for an "on-track" process and system which overcomes the above-described drawbacks associated with conventional high-throughput, automated, track type manufacturing apparatus, particularly as employed in the metallization of LSI, VLSI, and ULSI semiconductor devices having multiple metallization levels. Moreover, there exists a need for an improved "on-track" process and apparatus for electroplating and post-treatment of semiconductor wafers for metallization thereof, which process and apparatus are fully compatible with the balance of conventional semiconductor manufacturing lines.

DISCLOSURE OF THE INVENTION

An advantage of the present invention is an improved method for plating workpieces in a plating system comprising a plurality of interconnected stations.

A further advantage of the present invention is an improved method for metallizing semiconductor wafer workpieces utilizing an in-line, automated, on-track manufacturing system.

A still further advantage of the present invention is an improved method for plating workpieces in a system comprising a plurality of interconnected stations and which provides for "on-site" monitoring of plating characteristics and adaptive process control.

Yet another advantage of the present invention is an improved plating system for use in an in-line, "on-track" or radially arranged manufacturing apparatus and comprising "on-site" monitoring means and adaptive process control.

Additional advantages, and other features of the present invention will be set forth in the description which follows and in part will become apparent to those having ordinary skill in the art upon examination of the following or may be learned from the practice of the present invention. The advantages may be realized and obtained as particularly pointed out in the appended claims.

According to the present invention, the foregoing and other advantages are achieved in part by a method of plating at least one workpiece in a plating system comprising three interconnected stations, the method comprising the sequential steps of:

(a) supplying a workpiece from a workpiece holder to a first station of the system;

(b) plating the workpiece in the first station;

(c) supplying the plated workpiece to a second station of the system;

(d) post-treating the plated workpiece in the second station;

(e) supplying the post-treated plated substrate to a third station of the system;

(f) determining the value of at least one selected property of the plating in the third station;

(g) comparing the determined value(s) with (a) target value(s) or target range(s) of values; and (h) performing one of the following steps based upon the comparison:

i. transporting the post-treated, plated workpiece from the third station to the or a workpiece holder for storing therein if the determined value(s) correspond (s) with the target value(s) or is (are) within the target range(s) of values;

ii. transporting the post-treated, plated workpiece from the third station back to the first station for additional plating thereon if the determined value(s) is (are) below the target value(s) or the target range(s) of values;

iii. removing the post-treated, plated workpiece from the system if the determined value(s) indicate(s) that additional plating thereon cannot provide (a) determined value(s) corresponding with the target value (s) or target range(s) of values; or iv. adjusting the plating conditions within the first station to provide a later-plated workpiece with (a) determined value(s) which correspond(s) with the target value(s) or is (are) within the target range(s) of values.

In embodiments according to the invention, the workpiece comprises a semiconductor wafer substrate for an integrated semiconductor device, the workpiece holder comprises a cassette-type device for supplying/storing/receiving a single one or a plurality of such semiconductor wafer substrates multiply or in seriatim, and the first station comprises an apparatus for plating a metal by electroplating, electroless plating, dipping, pasting, spraying, physical vapor deposition, or chemical vapor deposition.

In preferred embodiments according to the present invention, the metal comprises copper or a copper-based alloy electroplated on the workpieces in the first station, the second station comprises a rinsing/drying station, the method comprising determining at least one of the electrical resistivity, thickness, and reflectivity of the plated metal in the third station, and utilizing an electronic computer for performing the comparison with (a) target value(s).

Another aspect of the present invention is a system for plating at least one workpiece which system comprises:

a workpiece holder for supplying/storing receiving at least one such workpiece;

a first station for receiving and plating the at least one workpiece;

a second station for receiving the at least one plated workpiece from the first station, performing post-treatment thereof, and supplying the at least one post-treated workpiece to a third station;

a third station for receiving the at least one post-treated workpiece and determining the value of at least one selected property of the plating;

an apparatus for controllably transporting the at least one workpiece between the stations and the workpiece holder; and a device for comparing the determined value(s) of the at least one selected plating property with (a) target value (s) or range(s) of target values, the comparison device adapted to controllably operate the system to perform one of the following based upon the comparison:

i. supplying of the plated, post-treated workpiece to the or a workpiece holder for receiving and/or storage therein if the determined value(s)of the at least one selected property corresponds with the target value (s) or is (are) within the target range(s) of values;

ii. supplying of the plated, post-treated workpiece back to the first, plating station for additional plating treatment if the determined value(s) is (are) below the target value(s) or the target range(s) of values;

iii. removal of the plated, post-treated workpiece from the system if the determined value of the at least one selected property indicates that additional plating treatment cannot result in (a) determined value(s) corresponding to the target value(s) or within the target range(s) of values; and iv. adjustment of the plating conditions within the first station to provide a later-plated workpiece with (a) determined value(s) of the at least one selected property corresponding with the target value(s) or within the target range(s) of values.

According to embodiments of the invention, the workpiece holder comprises a cassette-type device for accomodating therein a plurality of semiconductor wafer workpieces and the workpiece transport device comprises a linear "on-track" mechanism or a radially arranged mechanism with a centrally positioned robotic workpiece handler; the first station comprises an apparatus for plating a metal by electroplating, electroless plating, dipping, pasting, spraying, physical vapor deposition, or chemical vapor deposition and the second station comprises an apparatus for post-treating the metal plating.

In preferred embodiments according to the invention, the first station comprises an apparatus for electroplating, preferably copper or copper-based electroplating, the second station comprises an apparatus for rinsing and drying the metal plating, the third station comprises an apparatus for measuring at least one of the electrical resistivity, thickness, and reflectivity of the metal plating, and the comparison device comprises an electronic computer.

Additional advantages of the present invention will become readily apparent to those skilled in the art from the following detailed description, wherein only the preferred embodiments of the present invention are shown and described, simply by way of illustration but not limitation. As will be realized, the invention is capable of other and different embodiments, and its several details are capable of modification in various obvious respects, all without departing from the spirit of the present invention. Accordingly, the drawings and description are to be regarded as illustrative in nature and not as restrictive.

BRIEF DESCRIPTION OF THE DRAWINGS

The following detailed description of the embodiments of the invention can best be understood when read in conjunction with the following drawings, wherein.

DESCRIPTION OF THE INVENTION

Figure 1:
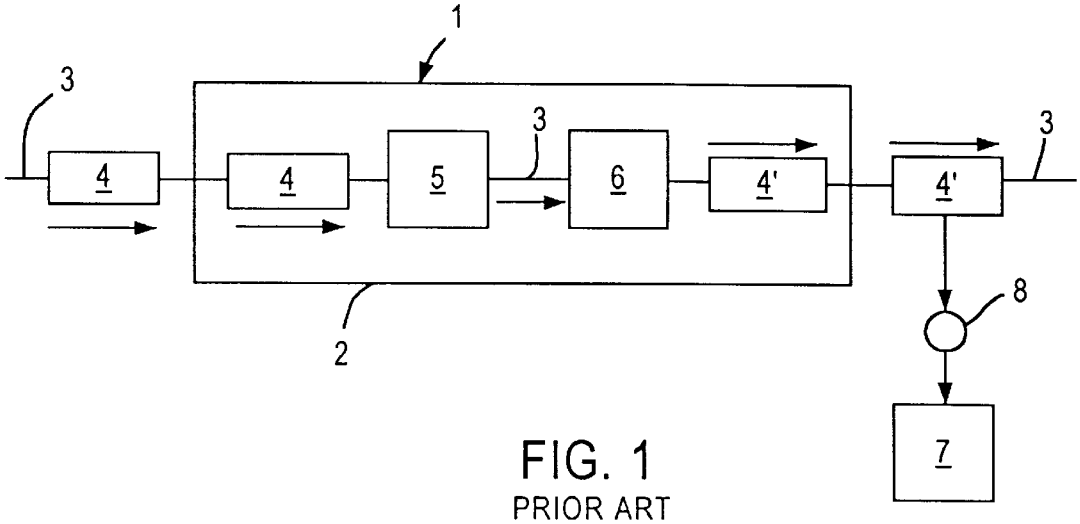
FIG. 1 PRIOR ART
FIG. 1 is a simplified schematic top view illustrating a conventional "on-track" type electroplating system forming part of an "in-line" semiconductor manufacturing line.
Figure 2:
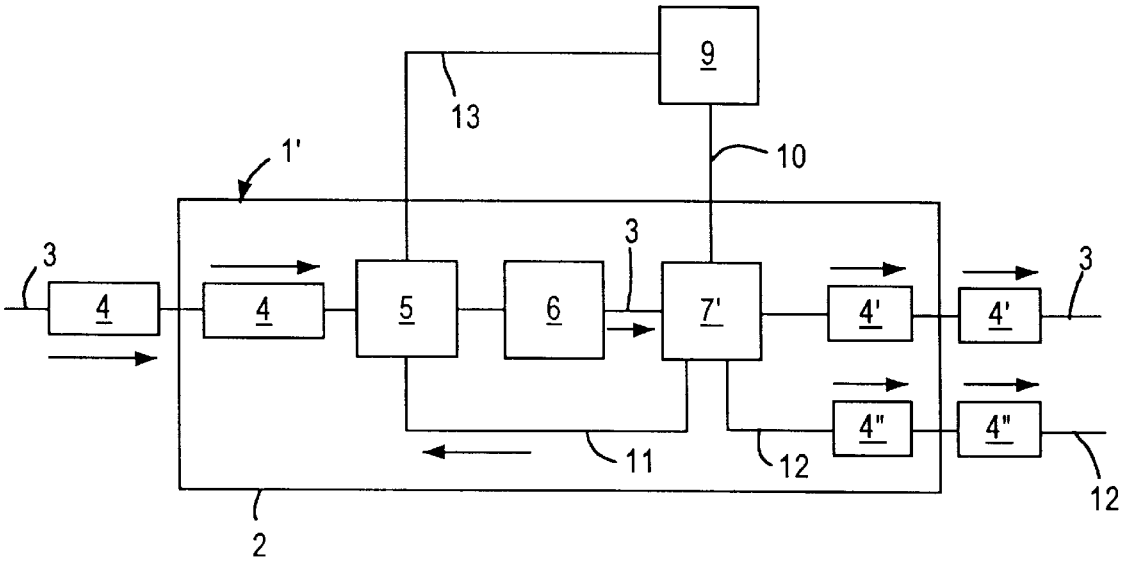
FIG. 2 is a simplified schematic top view of an "on-track" type electroplating system according to an embodiment of the present invention.

Referring now to FIG. 2, wherein like reference numerals are used to designate previously described features, an "on-track" metallization plating system 1' according to a first embodiment comprises an enclosure 2; a track-type workpiece transport mechanism 3; and, for illustrative purposes, entering and exiting cassette-type workpiece holders 4, 4', respectively. In serial arrangement therewith, are a first, electroplating station 5, a second, post-treatment (e.g., rinsing/washing) station 6, and a third, measuring station 7.

According to this embodiment, the third measuring station 7' is placed within the enclosure 2 for performing "on-site" measurement of the value of at least one of the aforementioned relevant plated film characteristics, e.g., resistivity, thickness, and/or reflectivity, and is operatively connected via line 10 to an electronic comparator/controller device 9, typically a digital computer. In addition, third station 7' is provided, for illustrative purposes, with a first and second auxiliary workpiece transport mechanisms 11 and 12, respectively, similar to track 3, and cassette-type workpiece holder 4", similar to cassettes 4, 4', for supplying selected workpieces from the third, measuring station 7' back to the first, plating station 5 for additional plating thereon or for exiting of selected "off-specification" plated workpieces from the system enclosure 2. Finally, the first, plating station is operatively connected to comparator/controller 9, via line 13, for adjustment of the electroplating conditions therein, based upon the output of the comparator as determined by the comparison. Comparator/controller 9 is programmed or otherwise inputted with target values or ranges of target values of the relevant plating characteristics for comparison with those provided by the third, measuring station 7'.

Although comparator/controller 9 is illustrated as placed exteriorly of the enclosure 2, it may be placed within the latter if desired or otherwise convenient.

It is also understood that while the first plating station 5 has been described as performing electroplating of the workpieces, the present invention is capable of use with a variety of other types of metal or non-metal plating stations, including, but not limited to electroless plating, dipping, pasting, spraying, physical vapor deposition (e.g., evaporation, vacuum evaporation, sputtering, ion plating, cathodic arc deposition, etc.), and chemical vapor deposition, including plasma enhanced chemical vapor deposition. Moreover, although in the illustrated embodiment, copper or copper-based metal plating is performed, the principles of the invention are equally applicable to various other metals and metallic and non-metallic materials, including, for example, nickel, titanium, tungsten, tantalum, aluminum, chromium, gold, silver, and their various alloys and compounds. Finally, the second, post-treatment station 6 is not limited to performing rinsing/drying treatment, but may be configured to perform any desired treatment necessitated by the particular plating method conducted in the first chamber 5.

Operation of the system 1' according to the present invention is generally similar to that of the conventional system described above, with the following notable difference: each workpiece, or alternatively, selected workpieces exiting the second, post-treatment station 6 pass(es) to and through the "on-site" third, measuring station 7, for determination of one or more relevant plating characteristics, typically resistivity, thickness, and/or reflectivity. The results of the comparison are then supplied via line 10 to comparator/controller 9.

Depending upon the result of the comparison, comparator/controller 9 determines which of the following possible outcomes occurs for each workpiece or selected workpieces:

(1) if the measured value(s) of the plating characteristic(s) as determined by the third, measuring station 7' correspond (s) with the target value(s) or is (are) within the target range(s) of values programmed into the comparator/controller 9, the plated, post-treated workpieces are supplied from the measuring station 7' to cassette-type workpiece holder 4' via on-track mechanism 3 for exiting enclosure 2 of plating system 1 to receive further processing downstream of the production line.

(2) if the measured value(s) of the relevant plating characteristics determined by the third measuring station 7' indicate that the plated, post-treated workpieces are below the target values or ranges of target values stored in the comparator/controller 9, the latter, via line 10 and auxiliary workpiece transport mechanism 11, directs the return of such workpieces to first, electroplating station 5 for further plating thereon. Such "second pass" plating treatment is particularly useful in instances where the resistivity and/or thickness of the plating as determined by the third station 7' is (are) lower than the target value(s) or target range(s) of values.

(3) if the measured value(s) of the relevant plating characteristic(s) of the plated, post-treated workpieces as determined by the third measuring station 7' and compared with the corresponding value(s) or range(s) of values stored in the comparator/controller 9 indicate that the plated, post-treated "off specification" workpieces cannot benefit from additional plating in first station 5, comparator/controller 9, via line 10, signals the third station 7' to supply such workpieces to, for illustrative purposes, auxiliary workpiece cassette 4" for exiting the system enclosure 2 by means of second auxiliary transport mechanism 12. Such would obtain when, e.g., the plating thickness exceeds the target thickness or range of thicknesses or low reflectivity indicates unacceptably poor plating quality.

(4) if the measured values of the relevant plating characteristics indicate that later-treated workpieces would exhibit measured values closer to the target values stored in the comparator/controller 9, or would otherwise benefit from adjustment of the electroplating conditions in first station 5, controller/comparator 9 can perform such adjustment via line 13. Such capability is also useful when different types of workpieces are supplied or when plating conditions require changing for any reason.

It is therefore apparent that the inventive method and system represents a significant improvement over conventional "in-line" technology for the processing of workpieces such as semiconductor wafers. Specifically, the inventive method and apparatus provides for automated, continuous operation of a metallization system, increased product throughput, "on-site" process/product measurement, monitoring, and adaptive control, and is fully compatible with the balance of the in-line manufacturing technology.

In the previous descriptions, numerous specific details are set forth, such as particular materials and deveices, etc., in order to provide a thorough understanding of the present invention. However, it should be recognized that the present invention can be practiced without resorting to the details specifically set forth. For example, while the invention has been illustrated as particularly useful in the manufacture of semiconductor integrated circuit devices, the invention is capable of use in manufacturing numerous and various other devices or products requiring plating.

Only the preferred embodiments of the present invention are shown and described herein. It is to be understood that the present invention is capable of changes or modifications within the scope of the inventive concept as expressed herein.

What is claimed is:

1. A method of plating at least one workpiece in a plating system comprising three interconnected stations, which method comprises the sequential steps of:

(a) supplying a workpiece from a workpiece holder to a first station of the system;

(b) plating the workpiece in the first station;

(c) supplying the plated workpiece to a second station of the system;

(d) post-treating the plated workpiece in the second station;

(e) supplying the post-treated plated substrate to a third station of the system;

(f) determining the value of at least one selected property of the plating in the third station;

(g) comparing the determined value(s) with (a) target value(s) or target range(s) of values, utilizing a comparison device adapted for controllably selecting from the following of four alternative steps i.–iv., which one is to be performed on the plated workpiece, based upon the comparison:

i. transporting the post-treated, plated workpiece from the third station of the workpiece holder for storing therein if the determined value(s) corresponds with the target value(s) or is (are) within the target range (s) of values;

ii. transporting the post-treated, plated workpiece from the third station back to the first station for additional plating thereon if the determined value(s) is (are) below the target value(s) or the target range(s) of values;

iii. removing the post-treated, plated workpiece from the system if the determined value(s) indicate(s) that additional plating thereon cannot provide (a) determined value(s) corresponding with the target value (s) or within the target range(s) of values; and iv. adjusting the plating conditions within the first station to provide a later-plated workpiece with (a) determined value(s) which correspond(s) with the target value(s) or is within the target range(s) of values;

(h) selecting one of steps i.–iv.; and (i) performing the selected step.

2. The method as in claim 1, wherein the workpiece comprises a semiconductor wafer substrate for an integrated semiconductor device and the workpiece holder comprises a cassette device for supplying/storing/receiving a plurality of such semiconductor wafer substrates multiply or in seriatim, comprising supplying a plurality of the semiconductor wafer substrates to the first station for plating thereon.

3. A method as in claim 2, comprising supplying only selected substrates from the second station to the third station.

4. A method as in claim 2, wherein the first station comprises an apparatus for plating a metal by electroplating, electroless plating, dipping, pasting, spraying, physical vapor deposition, or chemical vapor deposition, comprising metal plating of the semiconductor wafer for providing contacts, interlevel connections, device routing, and/or interconnects.

5. A method as in claim 4, comprising plating a metal selected from the group consisting of nickel, titanium, tantalum, tungsten, aluminum, chromium, gold, silver, copper, and alloys thereof.

6. A method as in claim 5, comprising plating copper or a copper-based alloy.

7. A method as in claim 6, comprising electroplating copper or a copper-based alloy.

8. A method as in claim 4, comprising rinsing and drying the plated semiconductor wafers in the second station.

9. A method as in claim 4, comprising determining at least one of the electrical resistivity, thickness, and reflectivity of the metal plating in the third station.

10. A method as in claim 9, comprising determining the resistivity of the metal plating using a 4-point probe or a contactless device.

11. A method as claim 1, comprising utilizing an electronic computer for comparing the determined value with the target value or target range of values.

12. A system for plating at least one workpiece, comprising:

a workpiece holder for supplying/storing/receiving at least one such workpiece;

a first station for receiving and plating on the at least one workpiece;

a second station for receiving the at least one plated workpiece from the first station, performing post-treatment thereof, and supplying the at least one post-treated workpiece to a third station;

a third station for receiving the at least one post-treated workpiece and determining the value of at least one selected property of the plating;

an apparatus for controllably transporting the at least one workpiece between the stations and the workpiece holder; and a device for comparing the determined value(s) of the at least one selected plating property with (a) target value (s) or range(s) of values, the comparison device adapted to operate the system to controllably select from the following four alternative steps i.–iv., which one is to be performed on the plated workpiece, based upon the comparison:

i. supplying of the plated, post-treated workpiece to the workpiece holder for receiving and/or storage therein if the determined value of the at least one selected property corresponds with the target value (s) or is (are) within the target range(s) of values;

ii. supplying of the plated, post-treated workpiece back to the first, plating station for additional plating treatment if the determined value(s) of the at least one selected property is (are) below the target value (s) or the target range(s) of values;

iii. removal of the plated, post-treated workpiece from the system if the determined value of the at least one selected property indicates that additional plating treatment cannot result in (a) determined value(s) corresponding with the target value(s) or within the target range(s) of values; and iv. adjustment of the plating conditions within the first station to provide a later-plated workpiece with (a) determined value(s) of the at least one selected property corresponding with the target value or is (are) within the target range(s) of values.

13. A system as in claim 12, wherein the workpiece holder comprises a cassette device for supplying/storing/receiving a plurality of semiconductor wafer substrates multiply or in seriatim, and the transporting apparatus comprises an in-line, on-track mechanism or a radially configured arrangement with a centrally positioned robotic wafer handler mechanism.

14. A system as in claim 12, wherein the first station comprises an apparatus for plating a metal by electroplating, electroless plating, dipping, pasting, spraying, physical vapor deposition, or chemical vapor deposition.

15. A system as in claim 14, wherein the first station comprises an apparatus for electroplating.

16. A system as in claim 12, wherein the second station comprises an apparatus for post-treating.

17. A system as in claim 16, wherein the apparatus for post-treating comprises an apparatus for rinsing and drying of a plated workpiece.

18. A system as in claim 12, wherein the third station for determining the value of a selected property of the plating comprises an apparatus for measuring at least one of the electrical resistivity, thickness, and reflectivity of the plating.

19. A system as in claim 18, wherein the third station comprises an apparatus for measuring at least the electrical resistivity of the plating.

20. A system as in claim 19, wherein the apparatus for measuring the electrical resistivity comprises a 4-point probe or a contactless device.

21. A system as in claim 12, wherein the comparing device comprises an electronic computer.

* * * * *